US010867463B2

(12) United States Patent
Jafa et al.

(10) Patent No.: US 10,867,463 B2
(45) Date of Patent: Dec. 15, 2020

(54) VENDING MACHINE

(71) Applicant: PepsiCo, Inc., Purchase, NY (US)

(72) Inventors: Emad Jafa, Brewster, NY (US); Xuejun Li, White Plains, NY (US); Yong Serock, Newtown, CT (US); Cheuk Chi Lau, White Plains, NY (US); Martyn Mitchell, Royston (GB); Euan Morrison, Cambridge (GB); Wai Chan, Cambridge (GB); Sam Johnstone, Cambridge (GB); Erik Williams, Cambridge (GB)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/134,756

(22) Filed: Sep. 18, 2018

(65) Prior Publication Data

US 2020/0090445 A1 Mar. 19, 2020

(51) Int. Cl.
*G07F 11/50* (2006.01)
*G07F 11/42* (2006.01)

(52) U.S. Cl.
CPC ..... *G07F 11/50* (2013.01); *G07F 11/42* (2013.01)

(58) Field of Classification Search
USPC ..... 700/231, 232–237, 214; 221/1, 100, 10, 221/123, 121, 133
See application file for complete search history.

(56) References Cited

U.S. PATENT DOCUMENTS 4,519,522 A * 5/1985 McElwee ..... G07F 11/54 221/13
4,814,592 A * 3/1989 Bradt ..... G06Q 20/342 235/375
5,042,686 A * 8/1991 Stucki ..... G07F 7/069 194/217
5,143,193 A * 9/1992 Geraci ..... G07F 7/069 194/212

(Continued)

FOREIGN PATENT DOCUMENTS

CN 203858704 U 10/2014
EP 1063620 A1 12/2000
WO 2018163142 A2 9/2018

OTHER PUBLICATIONS

International Search Report and Written Opinion issued in International Application No. PCT/US2019/050127, dated Dec. 23, 2019, 40 pages.

*Primary Examiner* — Gene O Crawford
*Assistant Examiner* — Ayodeji T Ojofeitimi
(74) *Attorney, Agent, or Firm* — Sterne, Kessler, Goldstein & Fox P.L.L.C.

(57) ABSTRACT

A vending machine with a curved exterior shape is disclosed. Some embodiments of the vending machine are circular in design, and include a transparent upper housing that allows customers to see into the interior of the vending machine. Products for vending may be stored in a non-transparent lower housing. A centrally-located product delivery system transports products for vending from the lower housing to delivery portals located on the upper (Continued)

housing. The product delivery system is able to move along a vertical line and rotate through the horizontal plane and can deliver products from any portion of the lower housing to any delivery portals located on the upper housing.

16 Claims, 6 Drawing Sheets

(56) References Cited

U.S. PATENT DOCUMENTS 5,206,814 A * 4/1993 Cahlander ..... G07F 11/62 221/88
5,449,091 A * 9/1995 Dalziel ..... G11B 15/68 221/197
6,036,812 A * 3/2000 Williams ..... B65G 1/045 156/277
6,130,800 A * 10/2000 Ostwald ..... G11B 15/6825 360/92.1
6,230,930 B1 * 5/2001 Sorensen ..... G07F 11/16 221/131
6,253,955 B1 * 7/2001 Bower ..... G07F 11/14 221/150 R
7,044,330 B2 5/2006 Chirnomas
D541,871 S 5/2007 Chang
7,802,700 B2 * 9/2010 Ardern ..... G07F 11/16 221/123
7,860,606 B2 * 12/2010 Rudy ..... G11B 17/228 700/232
8,534,494 B2 * 9/2013 Black, Jr. ..... G07F 9/026 221/126
8,687,349 B2 * 4/2014 Truebenbach ..... G11B 17/225 361/679.01
2003/0085235 A1 * 5/2003 William ..... G07F 11/165 221/92
2005/0077311 A1 * 4/2005 Chang ..... G07F 11/10 221/121
2005/0189370 A1 * 9/2005 Carter ..... G07F 11/165 221/123
2006/0269384 A1 * 11/2006 Kiaie ..... B25J 9/0096 414/222.02
2007/0108222 A1 * 5/2007 Collins ..... G07F 11/165 221/251
2008/0061076 A1 * 3/2008 Hieb ..... G07F 11/165 221/220
2008/0149658 A1 * 6/2008 Hudis ..... G07F 9/02 221/2
2008/0264967 A1 * 10/2008 Schifman ..... G07F 11/44 221/133
2008/0290108 A1 * 11/2008 Tsunoda ..... G07F 11/16 221/133
2009/0261047 A1 * 10/2009 Merrow ..... G11B 17/225 211/41.12
2009/0261228 A1 * 10/2009 Merrow ..... G05D 23/1928 248/550
2009/0261229 A1 * 10/2009 Merrow ..... G11B 19/042 248/560
2009/0262445 A1 * 10/2009 Noble ..... G11B 17/225 360/31
2009/0265032 A1 * 10/2009 Toscano ..... G11B 17/225 700/218
2011/0226795 A1 * 9/2011 Sichich ..... G07F 11/165 221/1
2012/0029690 A1 * 2/2012 Bruck ..... G07F 11/24 700/232
2012/0136477 A1 * 5/2012 Merrow ..... G11B 17/225 700/218
2014/0224826 A1 * 8/2014 Otzen ..... G07F 11/165 221/1
2014/0367399 A1 * 12/2014 Smith ..... G07F 11/54 221/1
2016/0155286 A1 6/2016 Yasaka et al.
2018/0082757 A1 * 3/2018 Chambers ..... G16H 20/13

* cited by examiner

VENDING MACHINE

FIELD

The described embodiments generally relate to a vending machine and systems and methods for dispensing food and beverage products from a vending machine.

BACKGROUND

Vending machines are used to dispense food and beverage products to consumers in an automated fashion. A typical vending machine can contain a combination of beverages, such as soda, juice, or water, and food products, such as nuts, snack mix, and candy bars. Vending machines are typically designed as large, freestanding machines that are placed against a wall or in a corner in areas that are frequented by potential consumers.

BRIEF SUMMARY

A product dispenser of the disclosure includes a lower housing and an upper housing with a circular shape placed above the lower housing. A delivery portal is located on the upper housing and a product delivery system is located inside the upper and lower housings. The product delivery system is configured to transport a product from the lower housing to the delivery portal, which is configured to allow a user to receive the product after the delivery system has transported the product from the lower housing to the delivery portal.

A vending machine of the disclosure includes lower housing and an upper housing located above the lower housing. The upper housing includes a transparent section and a plurality of display shelves. A plurality of products are located in the lower housing, and one example of each of the plurality of products is also located on the display shelves such that each example is visible from the exterior of the upper housing. At least two of the examples fall along the same line of sight as viewed from the exterior of the housing. The vending machine of this embodiment also includes a product delivery system that includes a vertical central support, a product transporter moveably coupled to the central support, and a vertical actuation system coupled to the central support and the product transportation component. The vertical actuation system is configured to vertically position the product transportation component on the central support. The product delivery system also includes a rotational actuation system coupled to the product transportation component and the central support, wherein the rotational actuation system is configured to position the product transportation component along a 360 degree arc in a horizontal plane. The product transporter includes a product retention mechanism that is configured to releasably retain a product.

A vending machine of the disclosure includes a housing, a vertical central support, a product transporter moveably coupled to the central support, and a vertical actuation system coupled to the central support and the product transportation component. The vertical actuation system is configured to vertically position the product transporter on the central support. The vending machine of this embodiment also includes a rotational actuation system coupled to the product transportation component and the central support, wherein the rotational actuation system is configured to position the product transportation component along a 360 degree arc in a horizontal plane. The product transporter includes a product retention mechanism that is configured to releasably retain a product.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
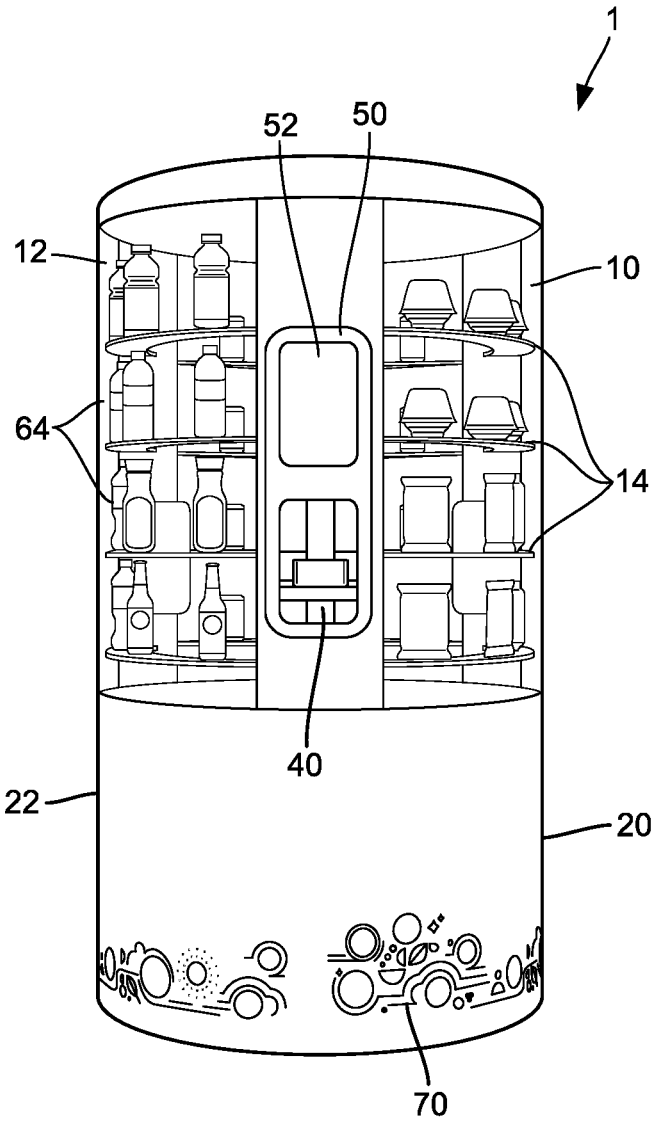
FIG. 1 is a front perspective view of a vending machine according to embodiments.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Vending machines are devices designed to automatically dispense products, including consumable products, such as soda or candy bars, to a consumer without the need for a salesperson to be present. These machines are configured to securely store the food products and dispense a selected product once payment for the product has been processed. A typical vending machine has a large, rectangular housing that stores the food products and contains the necessary input and payment systems. They are usually located along a wall or in a corner near a source of potential customers, such as a busy hallway.

The four vertical sides of a vending machine are usually different. The front face usually contains a user interface, a delivery portal, and advertising or branding. The other three faces may have advertising or branding, but are often undecorated because of the typical placement of a vending machine against a wall or in a corner formed by two walls. Often, the front face is the only face visible to customers, and thus the only face of a vending machine that needs to be decorated. Furthermore, the front face is the only face that will have a delivery portal and user interface.

Thus, most vending machine can only serve customers from one direction, and are also best installed against a wall or in a corner to minimize the visibility of the undecorated side and back walls. This creates an issue when alternative locations for the installation of a vending machine are desirable. For example, placing a vending machine in the middle of a large hallway that is frequented by potential customers may be desirable. However, the concerns discussed above mean that an ordinary vending machine will not be a visually pleasing addition to an open space, and customers will only be able to purchase products from one side of the vending machine. Embodiments described herein are directed to a vending machine that is designed to provide a visually pleasing and more easily accessible vending machine for alternative machine placement, such as in open spaces.

With reference to FIG. 1, an embodiment of a vending machine 1 includes a lower housing 20 formed in a circular shape and an upper housing 10 formed in a circular shape that is disposed above lower housing 20. A delivery portal 40 is located on upper housing 10. A vending product 62 is located in lower housing 20 and a product delivery system 30 is located in lower housing 20 and upper housing 10, wherein product delivery system 30 is configured to transport vending product 62 from lower housing 20 to delivery portal 40. Delivery portal 40 is configured to allow a user to receive vending product 62 after product delivery system 30 has transported vending product 62 from lower housing 20 to delivery portal 40. One advantage of the circular shape of vending machine 1 is that vending machine 1 is more visually appealing when it is placed in locations away from a wall. Furthermore, some embodiments of vending machine 1 include multiple delivery portals 40 spaced along the surface of vending machine 1, which allows customers to purchase and retrieve vending products 62 from multiple sides of vending machine 1.

As best seen in FIGS. 1-4, upper housing 10 may be at least partially formed in a curved shape with a constant radius of curvature. In some embodiments, upper housing 10 may form a complete circle. In other embodiments, housing 10 may be partially curved, with a straight segment of upper housing 10 connecting the two ends of the curved segment of upper housing 10. For example, the curved section of upper housing 10 may span 180 degrees. Upper housing 10 includes an upper housing wall 12 that forms the outer surface of upper housing 10. In some embodiments, upper housing wall 12 may be designed to provide structural support for upper housing 10. Upper housing wall 12 may be made of any appropriate material, including metal, plastic, glass, or composite material. In some embodiments, upper housing wall 12 is made of a transparent material such as a transparent plastic or glass. The transparency of upper housing wall 12 may be such that the view through upper housing wall 12 is substantially unobstructed, i.e. upper housing wall 12 is optically clear. It is thus possible to see through embodiments of vending machine 1 with a transparent upper housing wall 12. In some embodiments, upper housing wall 12 may be partially transparent, such that the interior of upper housing 10 is not fully visible. In some embodiments, upper housing wall 12 may be fully opaque. In some embodiments upper housing wall 12 may include a combination of opaque, partially opaque, and transparent regions.

In embodiments, upper housing wall 12 may be digitized for display purposes. In this manner, upper housing wall 12 may include one or more upper housing display units 19 that are configured to display images that are visible from the exterior of vending machine 1. In some embodiments, display units 19 may be flexible display screens, such as, flexible LED electronic visual displays, disposed on the inside of upper housing wall 12.

Figure 3:
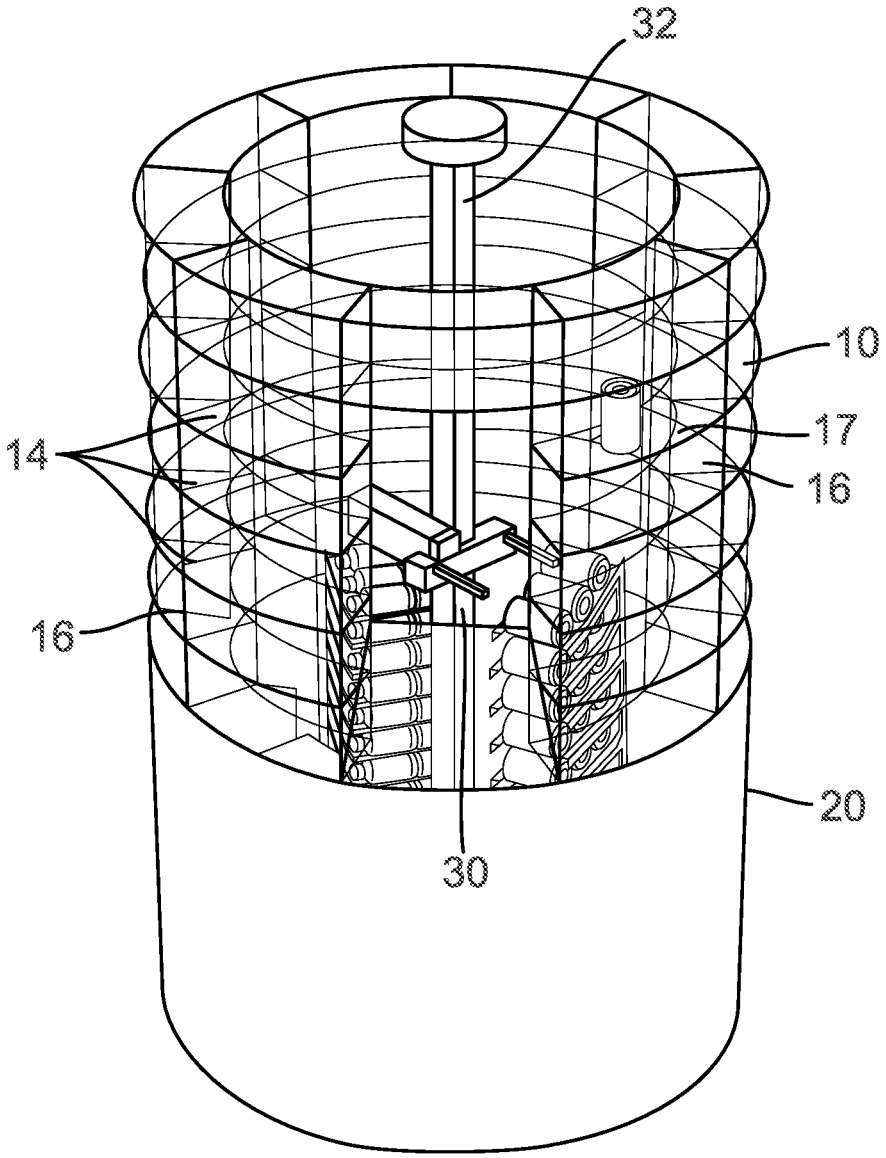
FIG. 3 is a partial transparent, cross-section view of a vending machine according to embodiments.
Figure 4:
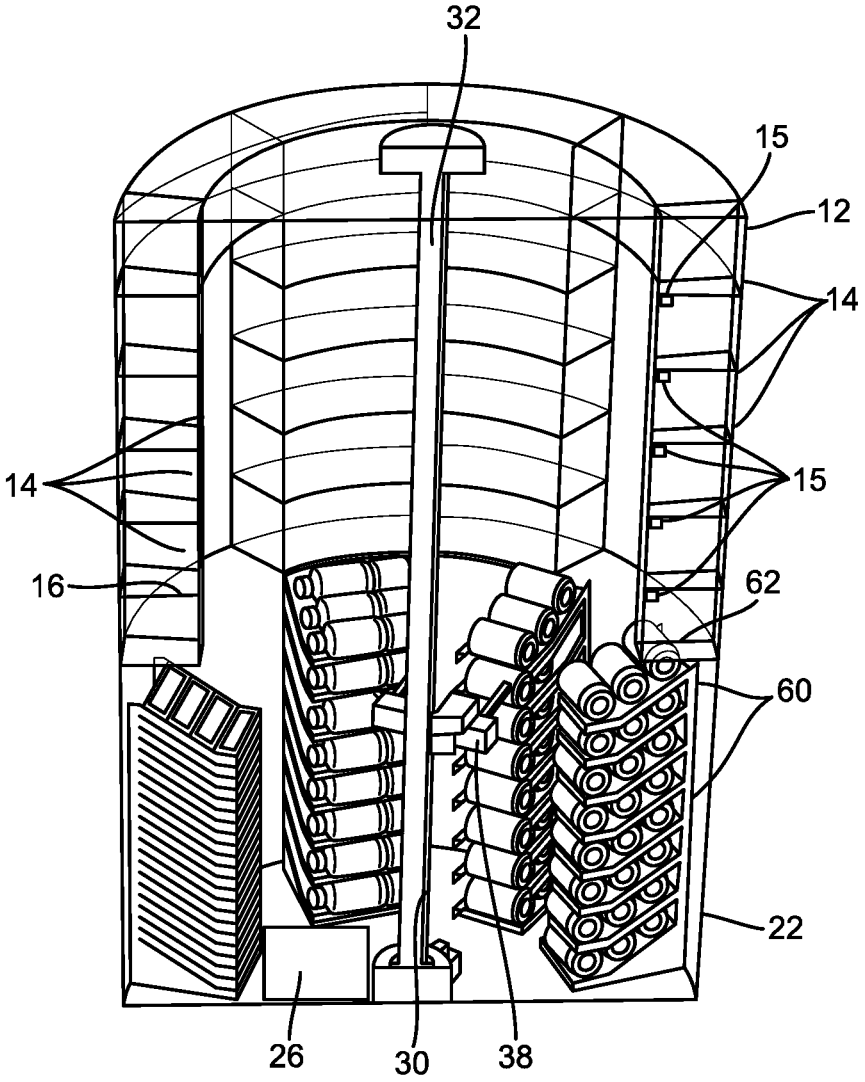
FIG. 4 is a cross section of a vending machine according to embodiments.
Figure 5:
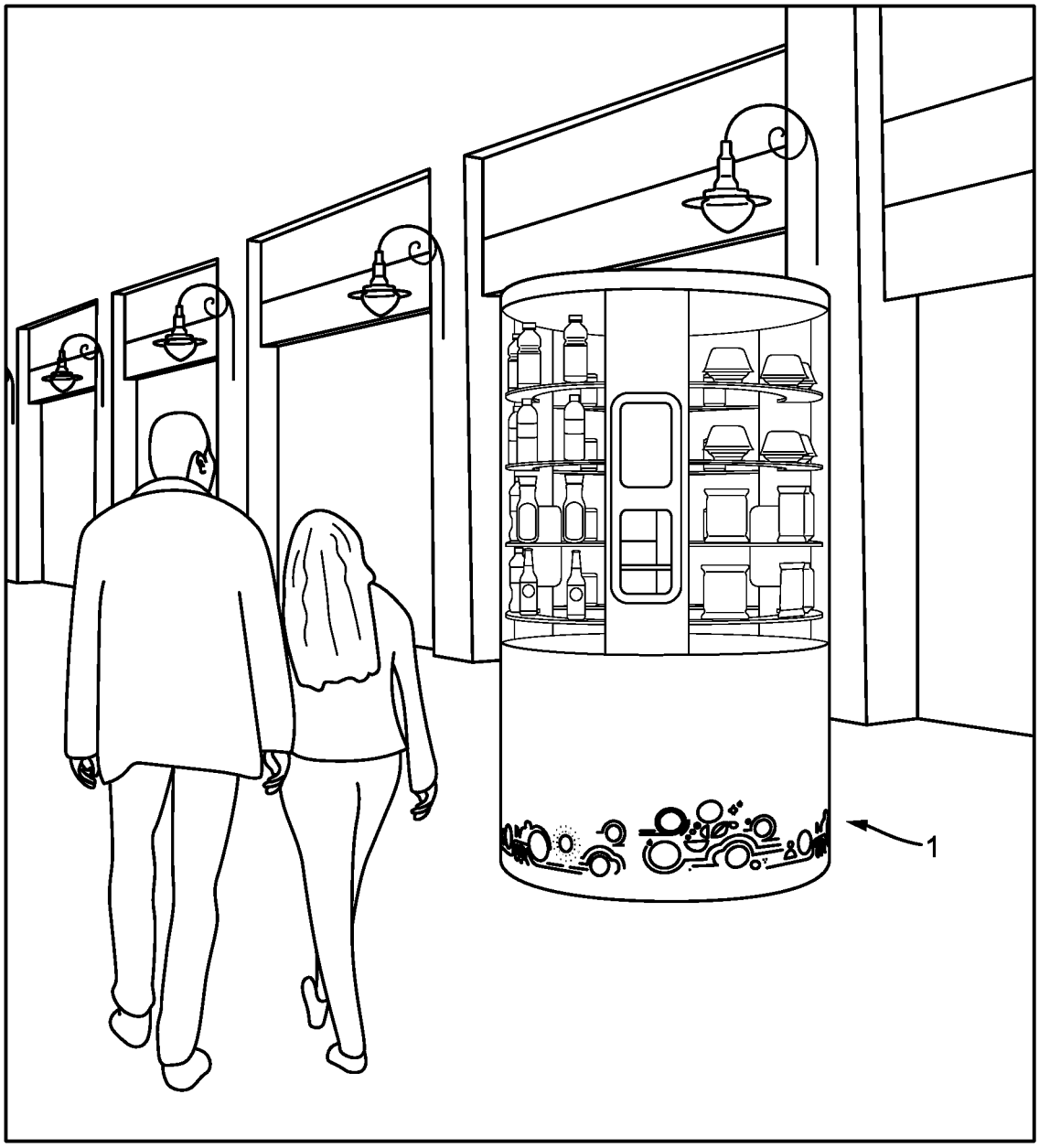
FIG. 5 is a schematic view of a vending machine in a retail environment according to embodiments.

Upper housing 10 may include display shelves 14. As can be seen in FIGS. 3 and 4, display shelves 14 may be horizontally oriented and extend radially inward from the inner surface of upper housing wall 12. Display shelves 14 may also include vertically-oriented display shelf walls 16 that extend radially inward from the inner surface of upper housing wall 12 and that are configured to create display units 17 that are discrete and separate sections of display shelves 14. Display shelves 14 are configured to contain display products 64, which are samples of vending products 62 that are not available for vending. For example, each display unit 17 may be configured to hold a single display product 64. In embodiments of vending machine 1 that are configured with an upper housing 10 having at least a 180 degree curved section and a transparent upper housing wall 12, it is possible to see two display products 64 in the same line of sight because of the semi-circular nature of upper housing 10.

Display shelves 14 and display shelf walls 16 may be made of the same material as upper housing wall 12. In some embodiments, display shelves 14 and display shelf walls 16 may also be made of a transparent material. Upper housing 10 may also contain display lighting 15 that is configured to illuminate display shelves 14 and any display products 64 that are located on display shelves 14. Display lighting 15 may be any type of lighting that is suitable for illuminating display shelves 14. In an embodiment, the intensity and color of the illumination produced by display lighting 15 may be varied. Such variation of intensity and illumination may be controlled by a control unit 18 disposed in vending machine 1. For example, control unit 18 may configure display lighting 15 to spotlight products on display that are on sale, or may command display lighting 15 to illuminate in patterns designed to attract customers. In some embodiments, display lighting 15 may illuminate in the ultraviolet (UV) spectrum, and display shelves 14 may further comprise fluorescent paint. When display lighting 15 illuminate the fluorescent paint with UV light, the fluorescent paint may glow in order to better highlight specific display units 17.

In some embodiments, display units 17 may contain digital displays that are configured to be visible from the exterior of vending machine 1. These displays may display a combination of images, including images of display products 64, branding, and other images designed to attract the attention of potential customers.

Upper housing 10 includes one or more delivery portals 40 located on the outer surface of upper housing wall 12, as best shown in FIG. 1. Delivery portal 40 is configured to receive vending product 62 and allow it to be retrieved by a customer without giving the customer access to the interior of vending machine 1. Examples of mechanisms to accomplish this type of access are well-known in the art and will not be discussed in detail here. In some embodiments, delivery portal 40 may be located on a section of upper housing wall 12 that is made of a material that is not transparent. There may be more than one delivery portal located on upper housing 10. In some embodiments, multiple delivery portals 40 are equally spaced around upper housing 10. For example, in an embodiment where upper housing 10 is circular and includes three delivery portals 40, each delivery portal 40 may be located 120 degrees from the other two delivery portals 40.

Lower housing 20 may be at least partially formed in a curved shape similar to that of upper housing 10. In some embodiments, the radius of curvature of lower housing 20 may be identical to that of upper housing 10. Lower housing 20 provides a base upon which upper housing 10 is mounted on. Lower housing 20 includes a lower housing wall 22 that forms the outer surface of lower housing 20. In some embodiments, lower housing wall 22 is designed to provide structural support for lower housing 20. Lower housing wall 22 may also be designed to support the weight of upper housing 10 attached above lower housing 20. Lower housing wall 22 may be made of any appropriate material, for example plastic, metal, glass, or composite material. In some embodiments, lower housing wall 22 is made from a non-transparent material such that the interior of lower housing 20 is not visible from the exterior of vending machine 1.

Figure 2:
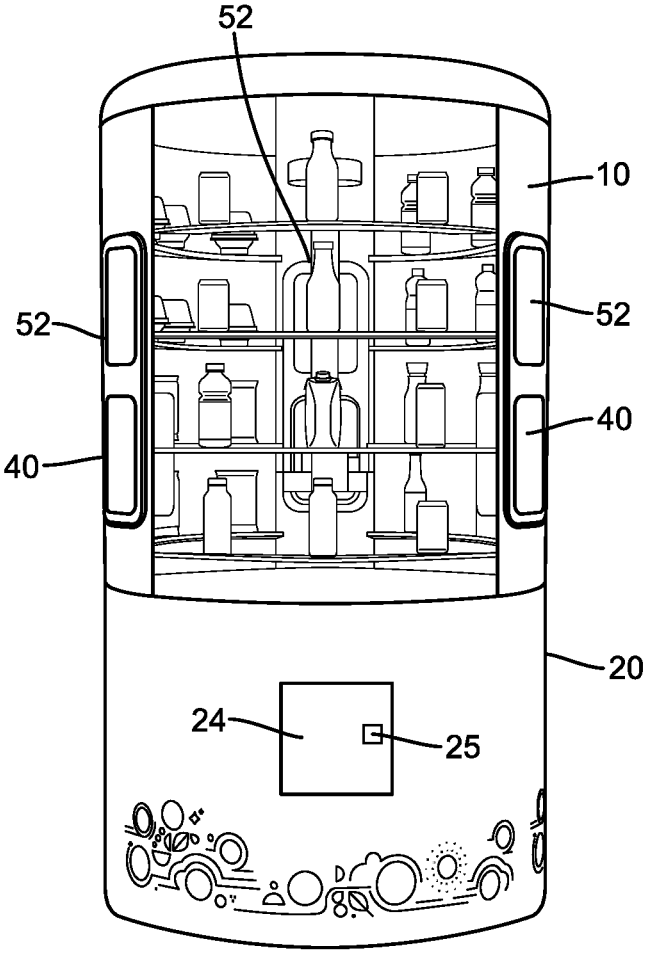
FIG. 2 is a side perspective view of a vending machine according to embodiments.

As best seen in FIG. 2, lower housing 20 may include a loading door 24 on the exterior surface of lower housing wall 22. Loading door 24 may be hingedly or removably attached to lower housing wall 22. In some embodiments, entire lower housing 20 may be configured to hinge open or to be removed, and thus lower housing 20 may act as loading door 24. Removing or swinging open loading door 24 will provide access to the interior of lower housing 20. In some embodiments, loading door 24 is sized to allow for removal and replacement of vending products 62 stored in lower housing 20. Loading door 24 may include a locking mechanism 25 that is designed to secure loading door 24 from unauthorized access. Lower housing 20 may also include advertising 70 visible from the exterior of lower housing 20. Advertising 70 may represent the brands of vending products 62 available for purchase.

As discussed above, vending products 62 are stored in lower housing 20. Vending products 62 may be food or beverage products such as candy bars, nuts, snack mix, soda, water, or juice. As best seen in the cross section of FIG. 4, vending products 62 may be stored in product storage cartridges 60 in some embodiments of vending machine 1. Product storage cartridges 60 are configured to releasably store one or more vending products 62. Each product storage cartridge 60 is typically used to store one type of vending product 62. Product storage cartridges 60 are releasably stored in lower housing 20 and may be quickly replaced to resupply vending machine 1 with additional vending products 62. Vending products 62, stored in product storage cartridges 60, may be disposed in a circular arrangement in lower housing 20 to maximize packing efficiency. In some embodiments, vending machine 1 may also include a refrigeration system 26 located in lower housing 20. Refrigeration system 26 may maintain a desired temperature inside vending machine 1.

In some embodiments, product storage cartridges 60 may use gravity to feed products 62 to product delivery system 30. In some embodiments, product storage cartridges 60 include an inventory tag 65 that contains information about the type of vending products 62 that are stored in each product storage cartridge 60. Inventory tag 65 may be a bar code or other machine-readable marks. Inventory tag 65 may also be capable of wireless data transmission, for example through a powered or unpowered radio frequency transmitter. In some embodiments, lower housing 20 may include a robotic cartridge positioning system 66 that is configured to receive product storage cartridges 60 through loading door 24 and position product storage cartridges 60 in the appropriate storage position. Cartridge positioning system 66 may include any known robotic system for positioning items in a vending machine, including, for example, a conveyor belt type system or a vertical/rotational robotic system similar to product delivery system 30 discussed below.

Figure 6:
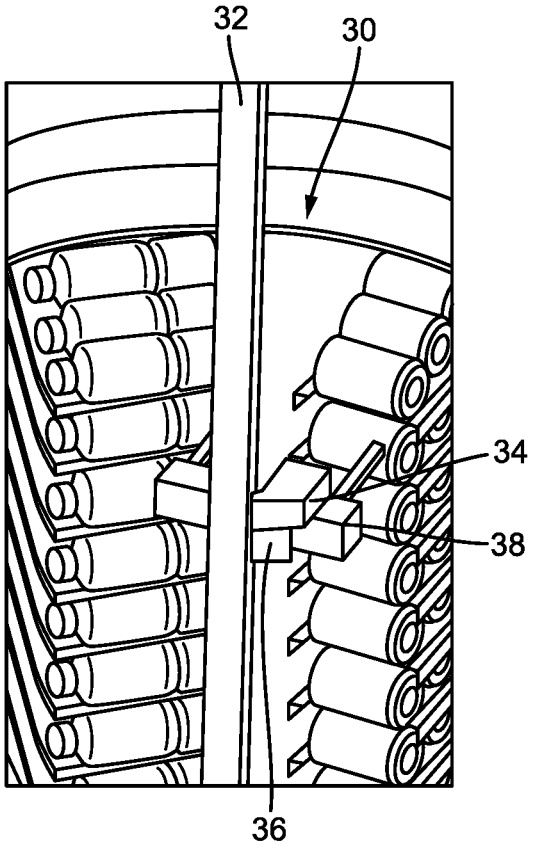
FIG. 6 is a detail view of a product delivery system according to embodiments.

Product delivery system 30 is located in lower housing 20 and upper housing 10. As best seen in FIGS. 3 and 4, product delivery system 30 spans the vertical height of both lower housing 20 and upper housing 10. Product delivery system 30 is configured to deliver vending products 62 from their storage location in lower housing 20 to delivery portal 40 in upper housing 10. A detail view of an embodiment of product delivery system 30 is shown FIG. 6. In this embodiment, product delivery system 30 includes a vertically oriented central support 32 that is disposed in the approximate center of vending machine 1. The components of product delivery system 30 are movably attached to central support 32.

Product delivery system 30 also includes a product transporter 38 that is designed to releasably hold one of vending product 62. Appropriate mechanisms that can releasably retain products for vending are well known in the art and will not be recited here. A vertical actuation system 34 is moveably attached to central support 32 and is coupled, via rotational actuation system 36, to product transporter 38. Vertical actuation system 34 is configured to move vertically along the height of central support 32. One possible embodiments of vertical actuation system 34 is a rack and gear mechanism, wherein a rack is fixed to central support 32 and a gear is meshed with the rack. The gear is connected to an actuator that is coupled to product transporter 38. The actuator can rotate the gear and thus control the vertical displacement of product transporter 38. Other possible variants of vertical actuation system 34 include, for example, a chain drive or belt system disposed in central support 32, wherein product transporter 38 is coupled to a chain or belt disposed on central support 32 that can be raised or lowered.

Rotational actuation system 36 couples vertical actuation system 34 and product transporter 38. Rotational actuation system 36 is configured to rotate product transporter 38 around central support 32 in the horizontal plane. One embodiment of rotational actuation system 36 is a ring-shaped housing that surrounds central support 32 and that contains a rack which is mated with a gear disposed on product transporter 38. This enables product transporter 38 to rotate completely around central support 32. This combination of vertical actuation and horizontal rotation enables product transporter 38 to reach any portion of the interiors of lower housing 20 and upper housing 10 because of the combination of full vertical travel and 360 degree rotation of product transporter 38. Thus, a single example of product delivery system 30 may service multiple delivery portals 40. Product delivery system 30 may be actuated by any appropriate actuators known in the art, including combinations of pneumatic systems, hydraulic systems, and electric motors.

A user interface 50 may be located on upper housing 10. User interface 50 is configured to receive inputs, such as order information, from customers. In an embodiment, user interface 50 includes a touchscreen 52 disposed on upper housing 10. User interface 50 may be located adjacent to delivery portal 40. Touchscreen 52 of user interface 50 may display various information needed to purchase vending product 62 from vending machine 1, including availability, price, and payment information. In embodiments of vending machine 1 with multiple delivery portals 40, each delivery portal 40 may have an adjacent user interface 50. User interface 50 includes a payment system 54 that is configured to accept payment for vending products 62. Payment system 54 may be adapted to accept multiple forms of payment, for example, cash, credit card, or electronic transfers.

The breadth and scope of the present disclosure should not be limited by any of the above-described exemplary embodiments, but should be defined only in accordance with the following claims and their equivalents.

What is claimed is:

1. A product dispenser comprising:

a lower housing;

an upper housing having a cylindrical shape and disposed above the lower housing, wherein a portion of the upper housing comprises a transparent material;

three delivery portals disposed on the upper housing, each of the delivery portals being spaced 120 degrees apart from the other two delivery portals; and a product delivery system disposed in the lower housing and the upper housing, wherein the product delivery system is configured to transport a product from the lower housing to the delivery portal, wherein the delivery portal is configured to allow a user to receive the product after the product delivery system has transported the product from the lower housing to the delivery portal.

2. The product dispenser of claim 1, wherein the lower housing comprises a loading door that is configured to allow access to the product from the exterior of the housing.

3. The product dispenser of claim 1, further comprising a plurality of horizontally oriented display shelves disposed in the upper housing, wherein each of the display shelves is configured to hold the product such that the product in the display shelf is visible from the exterior of the product dispenser.

4. The product dispenser of claim 1, further comprising a plurality of products, wherein the plurality of products are disposed in circular pattern inside of the lower housing.

5. The product dispenser of claim 4, wherein the product delivery system comprises:

a central support that is disposed in a vertical orientation in the center of the lower housing and the upper housing; and a product transporter that is configured to releasably retain one of the products and is moveably coupled to the central support, wherein the product transporter is configured to move vertically along the central support and to rotate in a horizontal plane around the vertical support, wherein the vertical movement and horizontal rotation of the product transporter is configured to allow the product transporter to receive any of the plurality of products and to transport the product to the delivery portal.

6. The product dispenser of claim 4, wherein the plurality of products are stored in a plurality of product storage cartridges that are releasably disposed in the lower housing.

7. A vending machine comprising:

a lower housing;

an upper housing disposed above the lower housing comprising a transparent section and a plurality of display shelves;

a plurality of products disposed in the lower housing;

one example of each of the plurality of products disposed on the display shelves such that each example of the plurality of products is visible from the exterior of the upper housing, wherein at least two of the examples fall along the same line of sight as viewed from the exterior of the housing; and a product delivery system comprising:

a vertical central support;

a product transporter moveably coupled to the central support;

a vertical actuation system coupled to the central support and the product transporter, wherein the vertical actuation system is configured to vertically position the product transporter on the central support; and a rotational actuation system coupled to the product transporter and the central support, wherein the rotational actuation system is configured to position the product transporter along a 360 degree arc in a horizontal plane, and wherein the product transporter comprises a product retention mechanism that is configured to releasably retain a product.

8. The vending machine of claim 7, wherein the housing comprises a cylindrical shape.

9. The vending machine of claim 8, wherein only the products stored in the lower housing may be dispensed.

10. The vending machine of claim 8, further comprising display lighting disposed in the upper housing that is configured to illuminate the display shelves.

11. The vending machine of claim 8, wherein the display lighting is configured to be selectively controlled to illuminate individual products by a control unit.

12. A vending machine, comprising:

a cylindrical housing comprising a transparent material;

a vertical central support;

a product transporter moveably coupled to the central support;

a vertical actuation system coupled to the central support and the product transporter, wherein the vertical actuation system is configured to vertically position the product transporter on the central support; and a rotational actuation system coupled to the product transporter and the central support, wherein the rotational actuation system is configured to position the product transporter in a horizontal plane, and wherein the product transporter comprises a product retention mechanism that is configured to releasably retain a product.

13. The product dispenser of claim 12, further comprising three delivery portals disposed on the housing.

14. The product dispenser of claim 12, further comprising a plurality of horizontally oriented display shelves disposed in the upper housing, wherein each of the display shelves is configured to hold the product such that the product in the display shelf is visible from the exterior of the product dispenser.

15. The product dispenser of claim 12, further comprising a plurality of products, wherein the plurality of products are disposed in circular pattern inside of the lower housing.

16. The product dispenser of claim 12, wherein the plurality of products are stored in a plurality of product storage cartridges that are releasably disposed in the lower housing.

* * * * *